US008224211B2

(12) United States Patent
Morimoto

(10) Patent No.: US 8,224,211 B2
(45) Date of Patent: Jul. 17, 2012

(54) DEVELOPING DEVICE AND IMAGE FORMING APPARATUS AND DEVELOPER CONVEYING METHOD USING THE SAME

(75) Inventor: Kiyofumi Morimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 421 days.

(21) Appl. No.: 12/554,422

(22) Filed: Sep. 4, 2009

(65) Prior Publication Data

US 2010/0074655 A1 Mar. 25, 2010

(30) Foreign Application Priority Data

Sep. 22, 2008 (JP) ..... 2008-242386

(51) Int. Cl.
*G03G 15/09* (2006.01)

(52) U.S. Cl. ..... 399/252

(58) Field of Classification Search ..... 399/252, 399/254, 258, 259, 275, 277
See application file for complete search history.

(56) References Cited

U.S. PATENT DOCUMENTS

| | | | |
|---|---|---|---|
| 6,694,108 | B2 | 2/2004 | Hirose et al. |
| 7,583,918 | B2 | 9/2009 | Samweber |
| 2003/0002881 | A1 | 1/2003 | Hirose et al. |
| 2008/0013990 | A1 | 1/2008 | Samweber |

FOREIGN PATENT DOCUMENTS

| | | | |
|---|---|---|---|
| CN | 1258028 | A | 6/2000 |
| JP | 1-144080 | | 6/1989 |
| JP | 10-63081 | A | 3/1998 |
| JP | 2005-134767 | | 5/2005 |
| JP | 2007-52324 | A | 3/2007 |
| JP | 2007-65400 | A | 3/2007 |
| JP | 2008-145875 | A | 6/2008 |
| JP | 2008-523429 | | 7/2008 |
| WO | WO 2006/061401 | A1 | 6/2006 |

*Primary Examiner* — David Gray
*Assistant Examiner* — Barnabas Fekete
(74) *Attorney, Agent, or Firm* — Birch, Stewart, Kolasch & Birch, LLP

(57) ABSTRACT

To provide a developing device, which includes: a first conveying passage through which a developer including a toner and a magnetic carrier is conveyed; a first conveying member disposed in the first conveying passage for conveying the developer in a predetermined whilst agitating; a toner supply port for supplying toner into the first conveying passage; and a multiple number of electromagnets arranged in the upper part of the first conveying passage and on the downstream side of the toner supply port with respect to the developer's direction of conveyance for creating magnetic fields inside the first conveying passage along the developer's direction of conveyance, and which can improve agitation performance and conveying performance of the developer without extremely increasing stress acting on the developer, as well as providing an image forming apparatus and developer conveying method using the device.

3 Claims, 10 Drawing Sheets

DEVELOPING DEVICE AND IMAGE FORMING APPARATUS AND DEVELOPER CONVEYING METHOD USING THE SAME

This Nonprovisional application claims priority under 35 U.S.C. §119(a) on Patent Application No. 2008-242386 filed in Japan on 22 Sep. 2008, the entire contents of which are hereby incorporated by reference.

BACKGROUND OF THE INVENTION

1. Field of the Invention

The present invention relates to a developing device as well as to an image forming apparatus and developer conveying method using the device, in particular relating to a developing device using a dual-component developer containing a toner and a magnetic carrier, for use in an image forming apparatus for forming image using the toner based on electrophotography as well as to an image forming apparatus and developer conveying method using this device.

Conventionally, image forming apparatuses based on electrophotography such as copiers, printers, facsimile machines and the like have been known. The image forming apparatus based on electrophotography is constructed so as to form an image by forming an electrostatic latent image on the surface of a photoreceptor drum (toner image bearer), supplying toner to the photoreceptor drum from a developing device to develop the electrostatic latent image, transferring the toner image formed on the photoreceptor drum by development to a sheet of paper or the like, and fixing the toner image onto the sheet by means of a fixing device.

Recently, in the image forming apparatuses capable of reproducing full-color and high-quality images, a dual-component developer (which will be referred to hereinbelow as simply "developer"), which can present an excellent stability of charge on the toner, is often used.

This developer consists of a toner and a carrier, which are agitated in the developing device and frictionally rubbed with each other, thereby producing a suitably electrified toner.

In the developing device, the electrified toner is supplied to a developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

2. Description of the Related Art

Besides, recently there is a demand for high-speed performance and miniaturization on image forming apparatuses, it is hence necessary to electrify the developer quickly and sufficiently and also convey the developer rapidly.

Accordingly, a circulating type developing device has been adopted in some image forming apparatuses in order to promptly diffuse supplied toner into the developer and produce an appropriate amount of static charge on the toner. The circulating type developing device includes a developer conveying passage through which the developer is circulatively conveyed, and a developer conveying member which agitates and conveys the developer through the developer conveying passage (JP10-063081A).

The above-mentioned circulating type developing device is constructed such that a toner is supplied from a toner hopper to the developer conveying passage when the toner concentration in the developer inside the developing device becomes lower than a predetermined level, and the supplied toner and the developer are conveyed whilst being agitated.

However, in the above-described conventional circulating type developing device, the supplied toner is conveyed while being mixed up (agitated) with the developer. If the agitating force is low, there occurs the problem that the toner is conveyed to the developing roller without gaining a sufficient amount of charge. On the other hand, if the agitation performance is enhanced by providing many parts such as agitating paddles, there occurs the problem that the developer receives much stress and hence is lowered in durability.

Particularly, if the agitating force is enhanced with respect to a dual-component developer including a micro-sized carrier and a micro-sized toner, the fluidity enhancer particles (external additive) for the toner gets stuck to the surface of the toner due to stress. Hence the fluidity of the developer lowers extremely. Accordingly, a defective agitation, so-called Debemoko phenomenon, which makes it difficult to convey the developer, becomes prone to occur. As a result, the necessary amount of toner cannot be supplied to the surface of photoreceptor drum, causing the problem of lowering image density.

SUMMARY OF THE INVENTION

The present invention has been devised in view of the above conventional problems, it is therefore an object of the present invention to provide a developing device with which the agitation performance and conveying performance of the developer can be improved without extremely increasing the stress acting on the developer, as well as providing an image forming apparatus and developer conveying method using the device.

In order to solve the above problems, the developing device of the present invention and the image forming apparatus and developer conveying method using this device, are configured as follows:

The present invention resides in a developing device including: a developer conveying passage through which a developer including a toner and a magnetic carrier is conveyed; a developer conveying member disposed in the developer conveying passage for conveying the developer in a predetermined direction whilst agitating the developer; a toner supply port for supplying the toner to the developer conveying passage; and a plurality of electromagnets arranged in an upper part of the developer conveying passage on the downstream side of the toner supply port with respect to a direction of conveying the developer for generating magnetic fields in the developer conveying passage along the direction of conveying the developer.

According to the present invention, it is preferred that the developer conveying member is comprised of a helical screw auger having a rotary shaft and a helical blade that is projectively formed perpendicularly to the axial direction of the rotary shaft.

According to the present invention, it is also preferred that the magnetic fields formed by the electromagnets are specified so that the magnetic flux density in the developer conveying passage falls within the range from 50 mT to 200 mT.

Also, the present invention resides in an image forming apparatus for forming images with toner based on electrophotography, comprising: a photoreceptor drum, on which an electrostatic latent image is formed, on a surface thereof; a charging device for electrifying the surface of the photoreceptor drum; an exposure device for forming the electrostatic latent image on the surface of the photoreceptor drum; a developing device for forming a toner image by supplying the toner to the electrostatic latent image on the surface of the photoreceptor drum; a toner supply device for supplying the toner to the developing device; a transfer device for transferring the toner image formed on the surface of the photoreceptor drum to a recording medium; and a fixing device for fixing the toner image on the recording medium, and being characterized in that the developing device employs the developing device mentioned above.

Also, the present invention resides in a developer conveying method for conveying a developer including a toner and a magnetic carrier in a developer conveying passage, in a predetermined direction whilst agitating the developer and the supplied toner by means of a developer conveying member, comprising the steps of: generating intermittent magnetic fields by, for example a plurality of electromagnets, at plural areas in the upper part of the developer conveying passage along the direction of conveying the developer; and conveying the developer whilst alternating attraction and release of the developer by the magnetic fields that are intermittently generated in the developer conveying passage.

According to the present invention, it is also preferred that the generation timing of the magnetic fields intermittently generated at plural areas in the upper part of the developer conveying passage is delayed as the area goes toward the downstream side of the direction of conveying the developer.

According to the present invention, it is also preferred that when the generation timing of the magnetic fields intermittently generated at plural areas in the upper part of the developer conveying passage is delayed as the area goes toward the downstream side of the direction of conveying the developer, the magnetic fields is not simultaneously generated by the two electromagnetics adjacent to each other.

According to the present invention, it is also preferred that the magnetic fields intermittently generated at plural areas in the upper part of the developer conveying passage are a sinusoidal magnetic field generated by flowing a sinusoidal current through electromagnets.

According to the present invention, it is also preferred that the generation timing of the magnetic fields intermittently generated at plural areas in the upper part of the developer conveying passage is delayed in phase of the sinusoidal current by the range of 90° to 120° as the area goes downstream with respect to the developer's direction of conveyance.

According to the present invention, since a developing device includes: a developer conveying passage through which a developer including a toner and a magnetic carrier is conveyed; a developer conveying member disposed in the developer conveying passage for conveying the developer in a predetermined direction whilst agitating the developer; a toner supply port for supplying the toner into the developer conveying passage; and a plurality of electromagnets arranged in the upper part of the developer conveying passage and on the downstream side of the toner supply port with respect to the direction of conveying the developer for generating magnetic fields in the developer conveying passage along the direction of conveying the developer, this configuration enables the developer to be conveyed whilst moving up and down by the developer conveying member under the magnetic fields which the electromagnets generate intermittently. Accordingly, it is possible to smoothly agitate and mix the supplied the toner with the developer without producing excessive stress on the developer. As a result, it is possible to improve agitation performance and conveying performance of the developer without causing rapid wear-out of the developer, and hence suppress the occurrence of the defective agitation, so-called Debemoko phenomenon. Accordingly, it is possible to alleviate the insufficient image density problem due to the occurrence of the Debemoko phenomenon and the toner scattering and image fogging problems resulting from the toner with insufficient static electricity.

Further, according to the present invention, since the developer conveying member is constructed of a helical screw auger having a rotary shaft and a helical blade that is projectively formed perpendicularly to the axial direction of the rotary shaft, this configuration makes the developer easily move in the rotational direction of the developer conveying member, hence the developer is unlikely to be hindered from moving up and down under the influence of the magnetic fields formed by the electromagnets.

Also, according to the present invention, since the magnetic fields generated by the electromagnets are specified so that the magnetic flux density in the developer conveying passage falls within the range from 50 mT to 200 mT, this makes it possible for the electromagnets to hold a sufficient amount of developer by the magnetic fields formed by the electromagnets while the fluidity of the developer remaining around the conveying member is not extremely lowered by the magnetic force, so that it is possible to suppress the wear-out of the developer.

Further, according to the present invention, since an image forming apparatus for forming images with toner based on electrophotography, includes: a photoreceptor drum, on which an electrostatic latent image is formed, on the surface thereof; a charging device for electrifying the surface of the photoreceptor drum; an exposure device for forming an electrostatic latent image on the surface of the photoreceptor drum; a developing device for forming a toner image by supplying toner to the electrostatic latent image on the surface of the photoreceptor drum; a toner supply device for supplying toner to the developing device; a transfer device for transferring the toner image formed on the surface of the photoreceptor drum to a recording medium; and a fixing device for fixing the toner image on the recording medium, and the developing device described above is used as the developing device, the supplied toner is promptly mixed with the developer so that the charge performance of the supplied toner is improved, it is hence possible to solve the problems of toner scattering and image fogging resulting from an insufficiency of static charge on the toner.

Further, according to the present invention, a developer conveying method for conveying the developer including a toner and a magnetic carrier inside a developer conveying passage, in a predetermined direction whilst agitating the developer and supplied toner by means of a developer conveying member, comprising the steps of: creating intermittent magnetic fields by, for example a plurality of electromagnets, at plural areas in the upper part of the developer conveying passage along the direction of conveying the developer; and conveying the developer whilst alternating attraction and release of the developer by the magnetic fields that are intermittently generated in the developer conveying passage. Accordingly, this configuration enables the developer to be conveyed moving up and down, by the developer conveying member under the magnetic fields which the electromagnets generate intermittently, so that it is possible to smoothly agitate and mix the supplied toner with the developer without acting excessive stress on the developer.

Also, according to the present invention, since the generation timing of the magnetic fields intermittently generated at plural areas in the upper part of the developer conveying passage is delayed as the area goes toward the downstream side of the direction of conveying the developer, the developer is once raised by the magnetic field, then is attracted to the neighboring electromagnet on the downstream side in the direction of conveying the developer, it is hence possible to efficiently convey the developer.

Further, according to the present invention, since, when the generation timing of the magnetic fields intermittently generated at plural areas in the upper part of the developer conveying passage is delayed as the area goes toward the downstream side in the direction of conveying the developer, the magnetic fields is not simultaneously generated by the two electromagnetics adjacent to each other, the developer once attracted by the magnetic field is dropped and then is attracted by another electromagnet located on the downstream side in the direction of conveying the developer, so that it is possible to improve conveying performance while increasing the up-and-down movement of the developer.

Moreover, according to the present invention, since the magnetic fields intermittently generated at plural areas in the upper part of the developer conveying passage are a sinusoidal magnetic field produced by flowing a sinusoidal current through electromagnets so as to change the currents through the electromagnets slowly, the magnetic flux density varies sinusoidally along the time axis and this makes it possible to alleviate the impact when the developer is attracted to the electromagnet and/or when the developer falls, whereby reducing stress on the developer.

Finally, according to the present invention, since the generation timing of the magnetic fields intermittently generated at plural areas in the upper part of the developer conveying passage is delayed in phase of the sinusoidal current by the range of 90° to 120° as the area goes downstream with respect to the direction of conveying the developer, the magnetic flux density of the magnetic field varies slowly, whereby suppressing stagnation of the developer and reducing the stress on the developer.

DETAILED DESCRIPTION OF THE INVENTION

The best mode for carrying out the present invention will hereinafter be described in detail with reference to the accompanying drawings.

Figure 1:
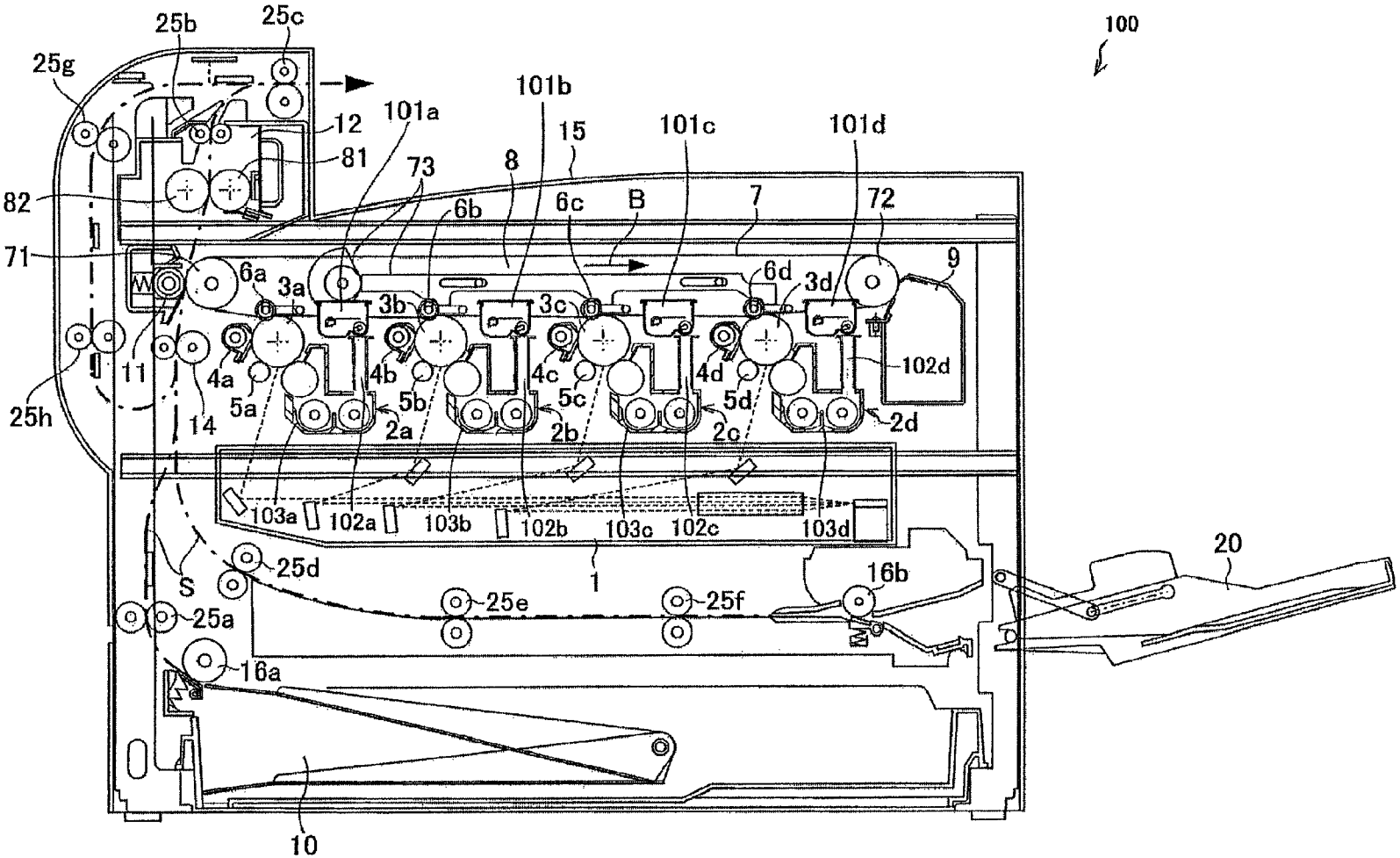
FIG. 1 is an illustrative view showing an overall configuration of an image forming apparatus including a developing device according to the embodiment of the present invention.

FIG. 1 is an illustrative view of one exemplary embodiment of the invention, showing the overall configuration of an image forming apparatus including a developing device according to the embodiment of the present invention.

The present embodiment resides in an image forming apparatus 100 that forms an image with toners based on electrophotography, including: as shown in FIG. 1, photoreceptor drums 3, on which electrostatic latent images are formed, on the surface thereof; chargers (charging devices) 5 for charging the surfaces of photoreceptor drums 3; an exposure unit (exposure device) 1 for forming electrostatic latent images on the photoreceptor drum 3 surfaces; developing devices 2 for supplying toners to the electrostatic latent images on the photoreceptor drum 3 surfaces to form toner images; toner hoppers (toner supplying devices) 101 for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium, and adopts the developing device according to the present invention as developing device 2.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 handles image data of separate color components, i.e., black (K), cyan (C), magenta (MA) and yellow (Y), and forms black, cyan, magenta and yellow images to form a full-color image from the images of different color components, by superposing one over another.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the parts for forming black images, 'b' the parts for forming cyan images, 'c' the parts for forming magenta images and 'd' the parts for forming yellow images. Image forming apparatus 100 further includes an exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, or a non-contact type discharging type charger etc. may be used.

Exposure unit 1 is a laser scanning unit (LSU) including a laser emitter and reflection mirrors as shown in FIG. 1. In addition to the laser scanning unit, another exposure units which include light emitting elements of electroluminescence (EL) that are disposed in an array, and a light-emitting diode (LED) writing head may be also applied instead of exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with the toner of K, C, M or Y. Developing device 2 (2*a*, 2*b*, 2*c* or 2*d*) includes a toner hopper 101 (101*a*, 101*b*, 101*c* or 101*d*), a toner transport mechanism 102 (102*a*, 102*b*, 102*c* or 102*d*), a developing vessel (developer receptacle) 111 (111*a*, 111*b*, 111*c* or 111*d*).

Toner hopper 101 is arranged on the upper side of developing vessel 111 and stores unused toner (power toner). The toner in toner hopper 101 is supplied to developing vessel 111 by means of toner transport mechanism 102.

Cleaner unit 4 removes and collects the toner remaining on the surface of photoreceptor drum 3 after development and image transfer.

Arranged over photoreceptor drums 3 is an intermediate transfer belt unit 8. Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73 of intermediate transfer belt unit 8. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). Intermediate transfer belt 7 is formed of an endless film of about 100 μm to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.,) coated on the shaft surface. Use of this conductive elastic material enables intermediate transfer roller 6 to uniformly apply a high voltage to intermediate transfer belt 7. Though in the present embodiment, roller-shaped elements (intermediate transfer rollers 6) are used as the transfer electrodes, brush-shaped elements can also be used in place.

The electrostatic latent image formed on each of photoreceptor drums 3 is developed with the toner associated with each color component into a visual toner image. The toner images are laminated on intermediate transfer belt 7, laying one over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Since the toner adhering to intermediate transfer belt 7 as the belt comes in contact with photoreceptor drums 3, or the toner which has not been transferred from intermediate transfer belt 7 to the paper during transfer of the toner image and remains on intermediate transfer belt 7, would cause contamination of color toners at the next operation, it is removed and collected by an intermediate transfer belt cleaning unit 9.

Intermediate transfer belt cleaning unit 9 includes a cleaning blade (cleaning member) that comes in contact with intermediate transfer belt 7. Intermediate transfer belt 7 is supported from an interior side thereof by intermediate transfer belt driven roller 72, at the portion where this cleaning blade comes into contact with intermediate transfer belt 7.

Paper feed tray 10 is to stack sheets (e.g., recording paper) to be used for image forming and is disposed under image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

A plurality of feed rollers 25 are small-diametric rollers arranged along sheet conveyor system S to promote and assist sheet conveyance. Pickup roller 16*a* is a roller disposed at one side of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the toner image on intermediate transfer belt 7.

Fixing unit 12 includes a heat roller 81, a pressure roller 82 and the like. These heat roller 81 and pressure roller 82 rotate while nipping the sheet. Heat roller 81 is controlled by a controller (not shown) so as to keep a predetermined fixing temperature. This controller controls the temperature of heat roller 81 based on the detection signal from a temperature detector (not shown).

Heat roller 81 fuses, mixes and pressurizes the lamination of color toner images transferred on the sheet by thermally pressing the sheet with pressure roller 82 so as to thermally fix the toner onto the sheet. Then, the sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 includes paper feed tray 10 that stacks sheets beforehand and manual feed tray 20 that is used when a few pages are printed out, as described above. Each tray is provided with pickup roller 16 (16*a*, 16*b*) so that the pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the lamination of toner images on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* to paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at the rear end thereof by paper discharge roller 25*c*. Then the paper discharge roller 25*c* is rotated in reverse so that the sheet is guided to feed rollers 25*g* and 25*h*, and conveyed again through registration roller 14 so that the sheet is printed on the rear side thereof and then discharged to paper output tray 15.

Next, developing device 2 characterizing the present embodiment will be described with reference to the drawings.

Figure 2:
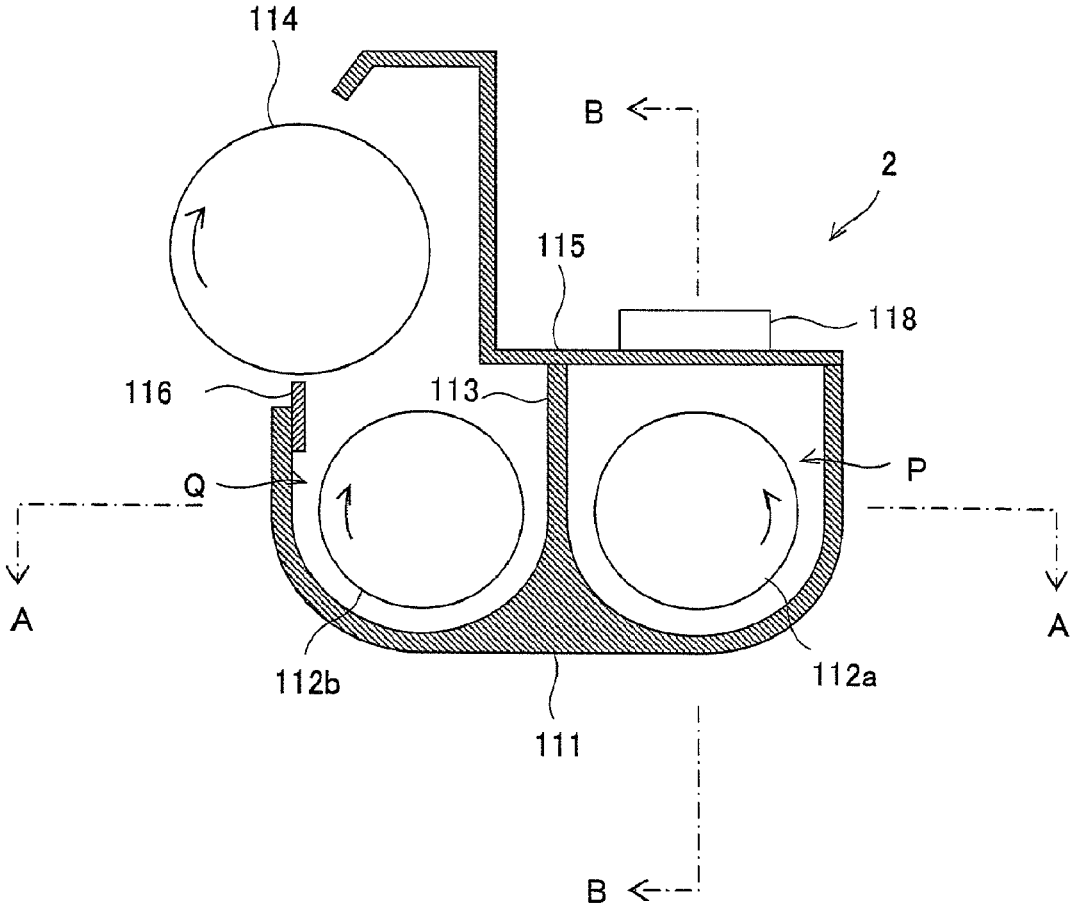
FIG. 2 is a sectional view showing the configuration of the developing device constituting the image forming apparatus.
Figure 3:
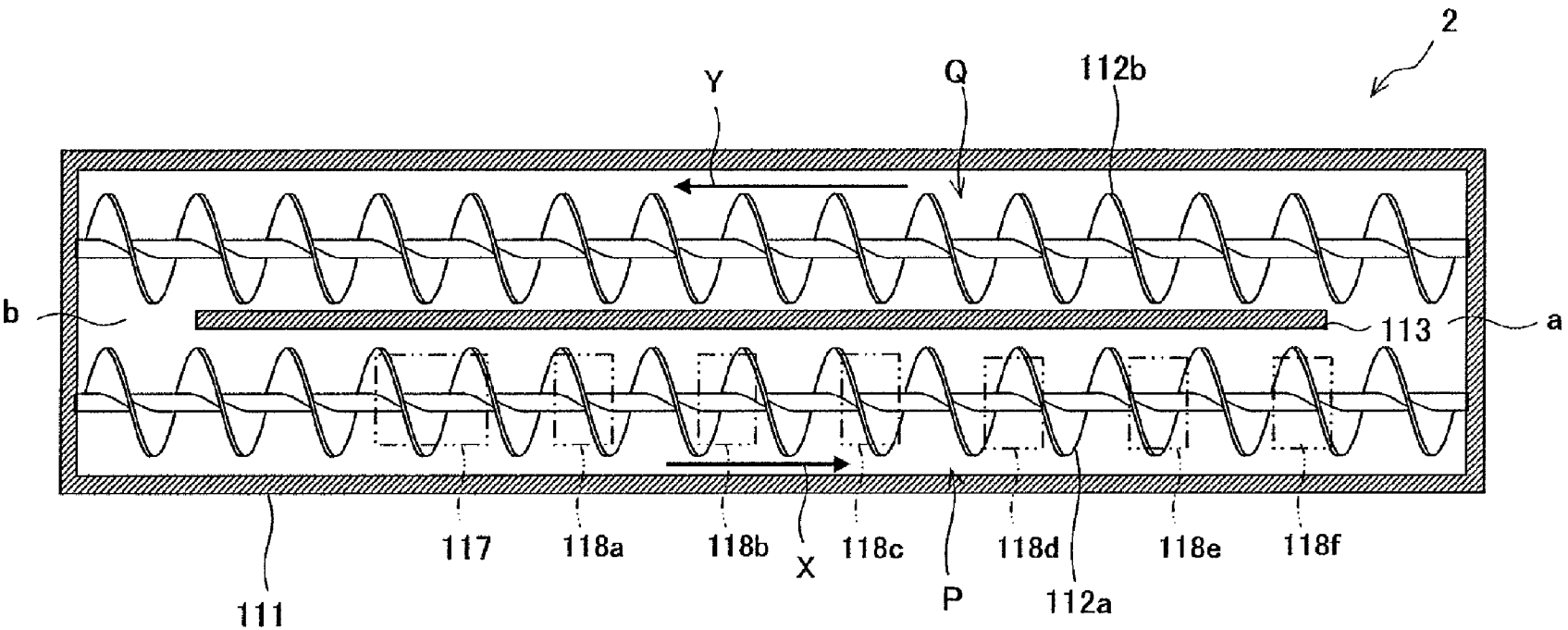
FIG. 3 is a sectional view cut along a plane A-A in FIG. 2.
Figure 4:
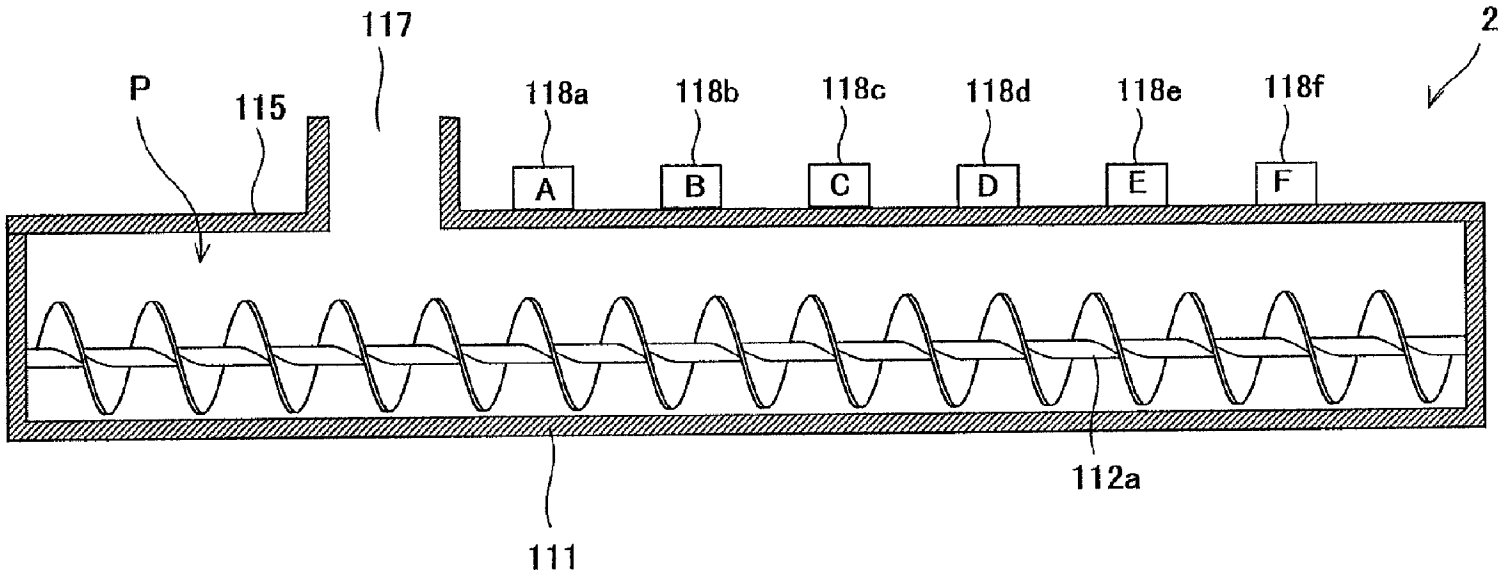
FIG. 4 is a sectional view cut along a plane B-B in FIG. 2.

FIG. 2 is a sectional view showing the configuration of the developing device constituting the image forming apparatus of the present embodiment. FIG. 3 is a sectional view cut along a plane A-A in FIG. 2. FIG. 4 is a sectional view cut along a plane B-B in FIG. 2.

Developing device 2 is a device that has a developing roller (developer supporting member) 114 arranged in developing vessel 111 so as to oppose photoreceptor drum 3 (FIG. 1), and supplies toner from developing roller 114 to the surface of the photoreceptor drum 3 to visualize (develop) the electrostatic latent image formed on the surface of photoreceptor drum 3.

As shown in FIGS. 2 to 4, developing device 2 includes, other than developing roller 114, developing vessel 111, a developing vessel cover 115, a toner supply port 117, a doctor blade 116, a first conveying member 112*a*, a second conveying member 112*b*, a partitioning plate (partitioning wall) 113 and electromagnets 118.

Developing vessel 111 is a receptacle for holding a developer including a toner and a carrier. Developing vessel 111 includes developing roller 114, first conveying member 112*a*, second conveying member 112*b* and the like. Here, the carrier of the present embodiment is a magnetic carrier made of a magnetic substance.

Developing roller 114 is a rotating magnet roller which draws up the developer in developing vessel 111 and supports the developer on the surface thereof and supplies toner from the developer supported on the surface thereof to photoreceptor drum 3. Doctor blade (layer thickness regulating blade) 116 is disposed at a position close to the developing roller 114 surface.

Developing vessel cover 115 is removably arranged on the top of developing vessel 111 as shown in FIGS. 2 and 4. Further, developing vessel cover 115 is formed with toner supply port 117 for supplying unused toner to developing vessel 111 as shown in FIG. 4 and provided with electromagnets 118 on the downstream side of toner supply port 117 with respect to the direction of conveying the developer by first conveying member 112*a*, as shown in FIG. 2.

Electromagnets 118 include six electromagnets A to F (118*a* to 118*f*), and are arranged above first conveying member 112*a* and on top of developing vessel cover 115. These electromagnets are connected to an unillustrated power supply. The magnetic field formed by electromagnets 118 is specified so that the magnetic flux density inside first conveying passage falls within the range from 50 mT to 200 mT.

In this arrangement, the toner stored in toner hopper 101 is transported to developing vessel 111 through toner transport mechanism 102 and toner supply port 117 as shown in FIG. 1. Accordingly, the toner is supplied to developing vessel 111.

Further, as shown in FIGS. 2, 3 and 4, first conveying member 112*a* and second conveying member 112*b* are formed of screw augers of a helical conveyor blade for agitating and conveying the developer inside developing vessel 111 so as to agitate and convey the developer as the shafts are rotationally driven by a driver (not shown) such as a motor etc.

First conveying member 112*a* and second conveying member 112*b* are arranged so that the peripheral sides oppose with each other, with a partitioning plate 113 put therebetween, and the shafts are positioned parallel to each other. The conveying members are set so as to rotate in opposite directions. As shown in FIG. 3, first conveying member 112*a* conveys the developer in the direction of an arrow X while second conveying member 112*b* conveys the developer in the direction of an arrow Y that is the opposite direction of arrow X.

Developing vessel 111 includes partitioning plate 113 between first conveying member 112*a* and second conveying member 112*b*. This partitioning plate 113 is arranged extending parallel to the direction of the shafts (the direction of rotational axes) of first conveying member 112*a* and second conveying member 112*b*. The interior of developing vessel 111 is divided by partitioning plate 113 into two sections, namely, a first conveying passage P with first conveying member 112*a* therein and a second conveying passage Q with second conveying member 112*b* therein.

Partitioning plate 113 is arranged so that the ends thereof, with respect to the axial direction of first and second conveying members 112*a* and 112*b*, are spaced from respective interior wall surfaces of developing vessel 111. Hereby, developing vessel 111 secures communicating paths that communicate between first conveying passage P and second conveying passage Q at around both axial ends of first and second conveying members 112*a* and 112*b*. In the following description, as shown in FIG. 3 the communicating path formed along the direction of arrow X is named first communicating path a and the communicating path formed along the direction of arrow Y is named second communicating path b.

In the present embodiment, toner supply port 117 is formed in the region inside first conveying passage P and on the downstream side of second communicating path b with respect to the direction of arrow X. In other words, toner is supplied into first conveying passage P at a position on the downstream side of second communicating path b.

In developing vessel 111, first conveying member 112*a* and second conveying member 112*b* are rotationally driven by a driver (not shown) such as a motor etc., to convey the developer.

More specifically, in first conveying passage P, the developer is agitated and conveyed in the direction of arrow X by first conveying member 112*a* to reach first communicating path a. The developer reaching first communicating path a is conveyed therethrough to second conveying passage Q.

On the other hand, in second conveying passage Q, the developer is agitated and conveyed in the direction of arrow Y by second conveying member 112*b* to reach second communicating path b. Then, the developer reaching second communicating path b is conveyed therethrough to first conveying passage P.

That is, first conveying member 112*a* and second conveying member 112*b* agitate the developer while conveying the developer in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn-up developer is continuously consumed as moving toward photoreceptor drum 3.

In order to compensate for this consumption of toner, unused toner is supplied from toner supply port 117 into first conveying passage P. The supplied toner is agitated and mixed with the previously existing developer in the first conveying passage P.

Next, the agitating and conveying operations and actions of developer D characterizing the developing device 2 according to the present embodiment will be described.

Figure 5:
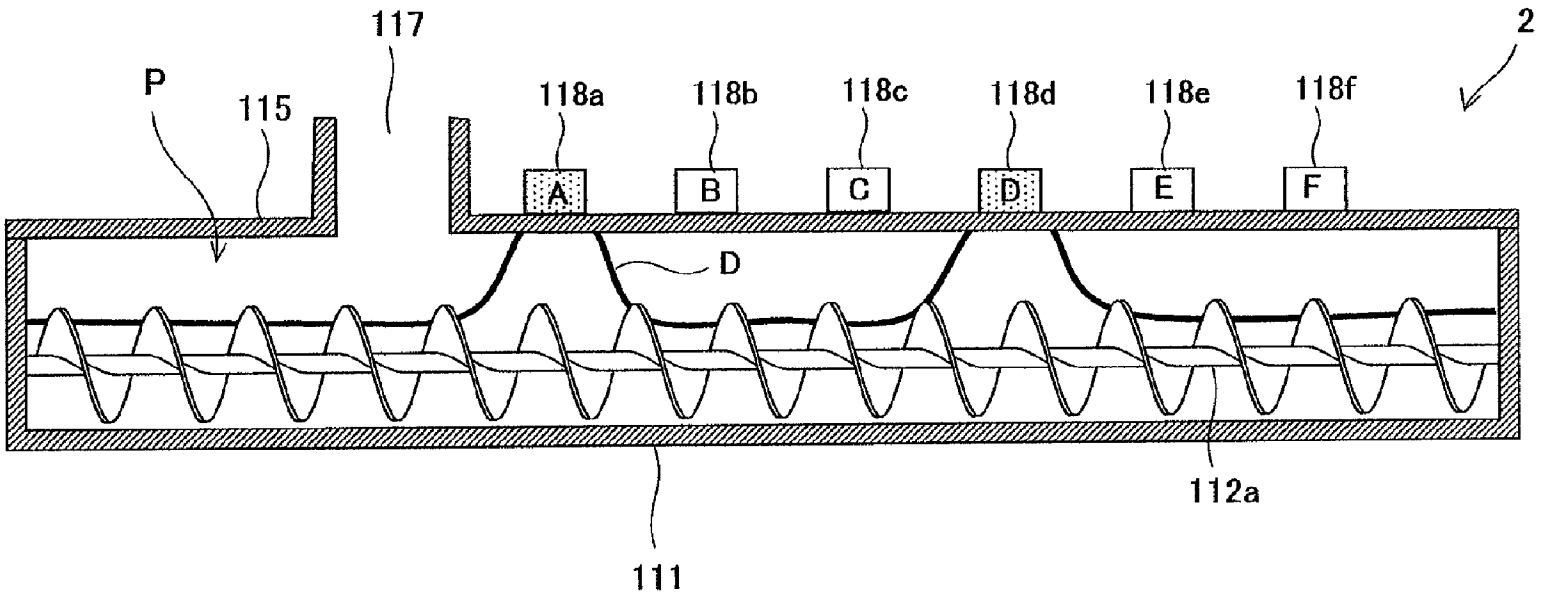
FIG. 5 is an illustrative view showing a state where the developer in the developer conveying passage has been attracted to particular two electromagnets of the electromagnets provided in the developing device when the electromagnets are energized.
Figure 6:
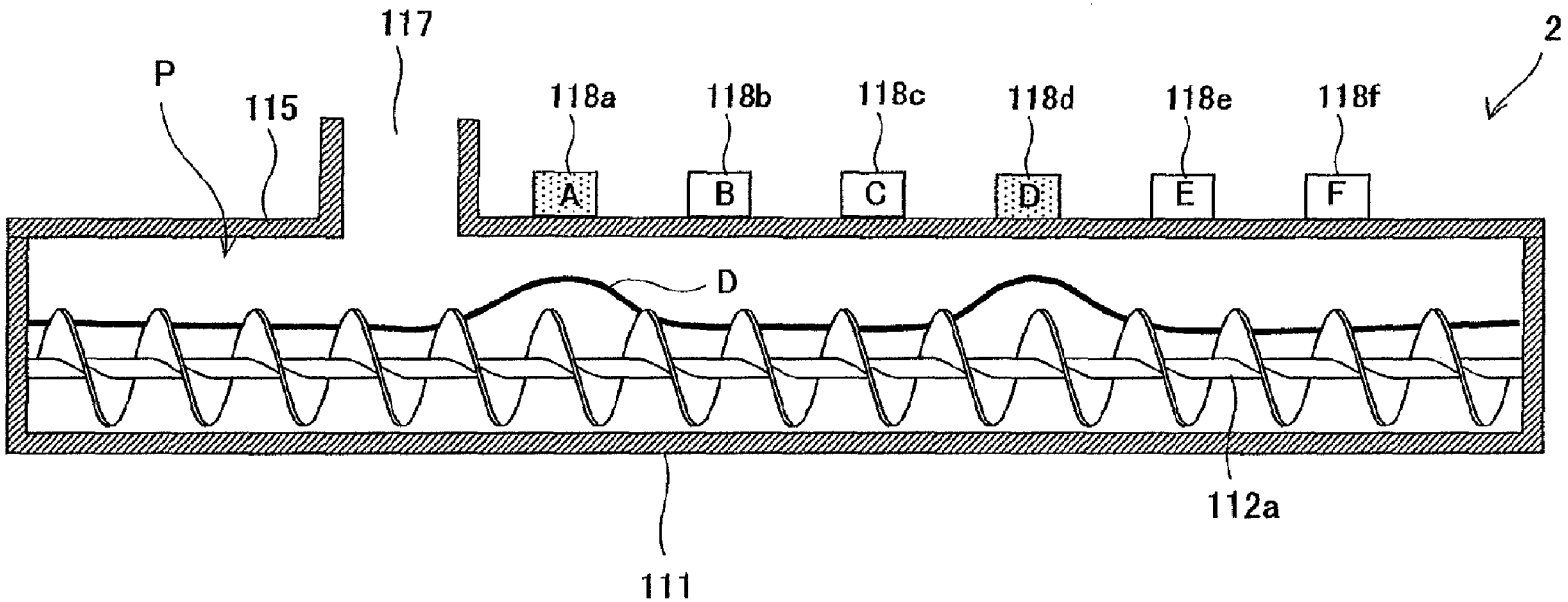
FIG. 6 is an illustrative view showing a state where the developer which was attracted to the electromagnets has dropped when the electromagnets in FIG. 5 are de-energized.
Figure 7:
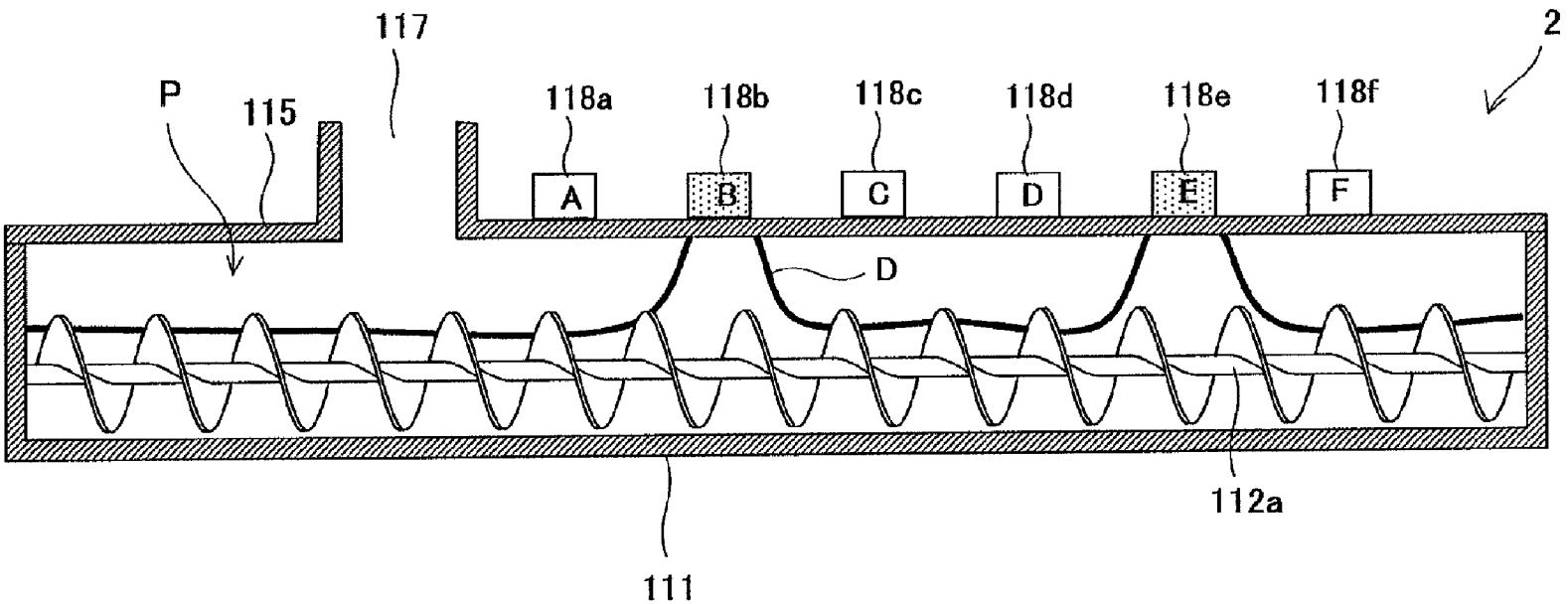
FIG. 7 is an illustrative view showing a state where the developer in the developer conveying passage has been attracted to two electromagnets on the downstream side of the two electromagnets in FIG. 5, with respect to the direction of conveying the developer when the electromagnets are energized.
Figure 8:
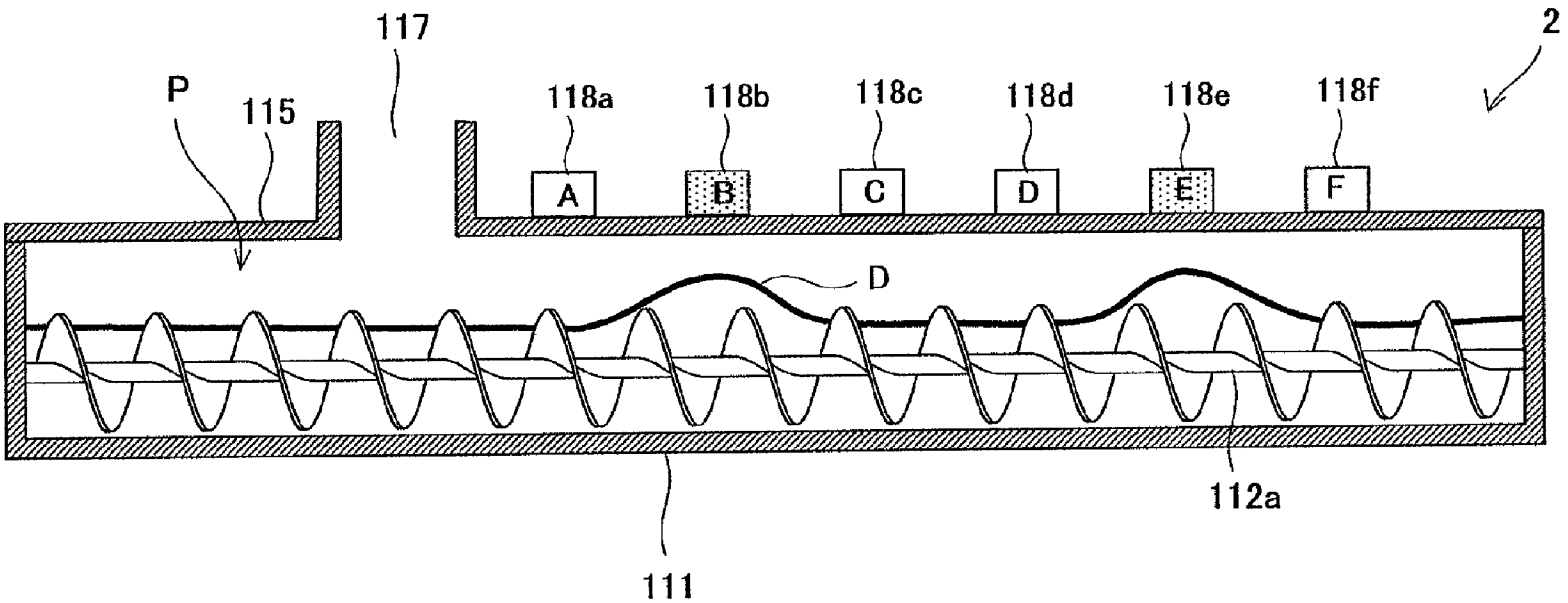
FIG. 8 is an illustrative view showing a state where the developer which was attracted to the electromagnets has dropped when the electromagnets in FIG. 7 are de-energized.
Figure 9:
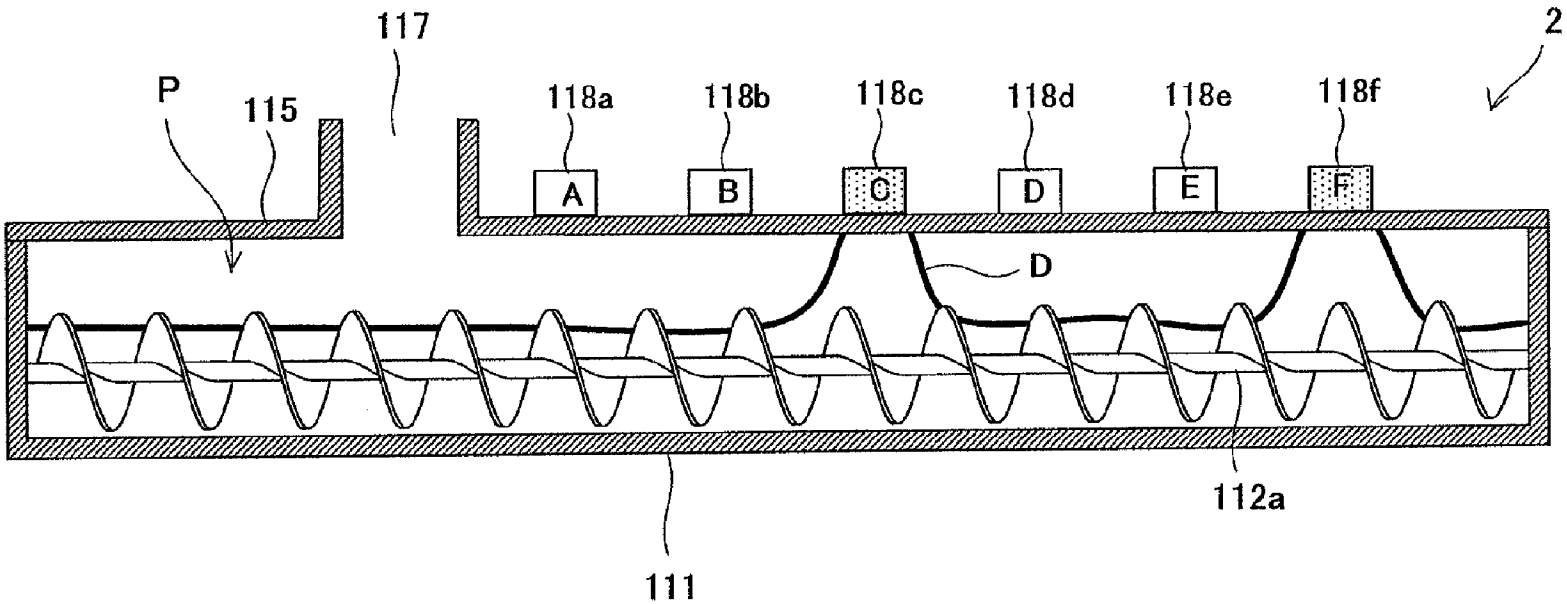
FIG. 9 is an illustrative view showing a state where the developer in the developer conveying passage has been attracted to two electromagnets on the downstream side of the two electromagnets in FIG. 7, with respect to the direction of conveying the developer when the electromagnets are energized.
Figure 10:
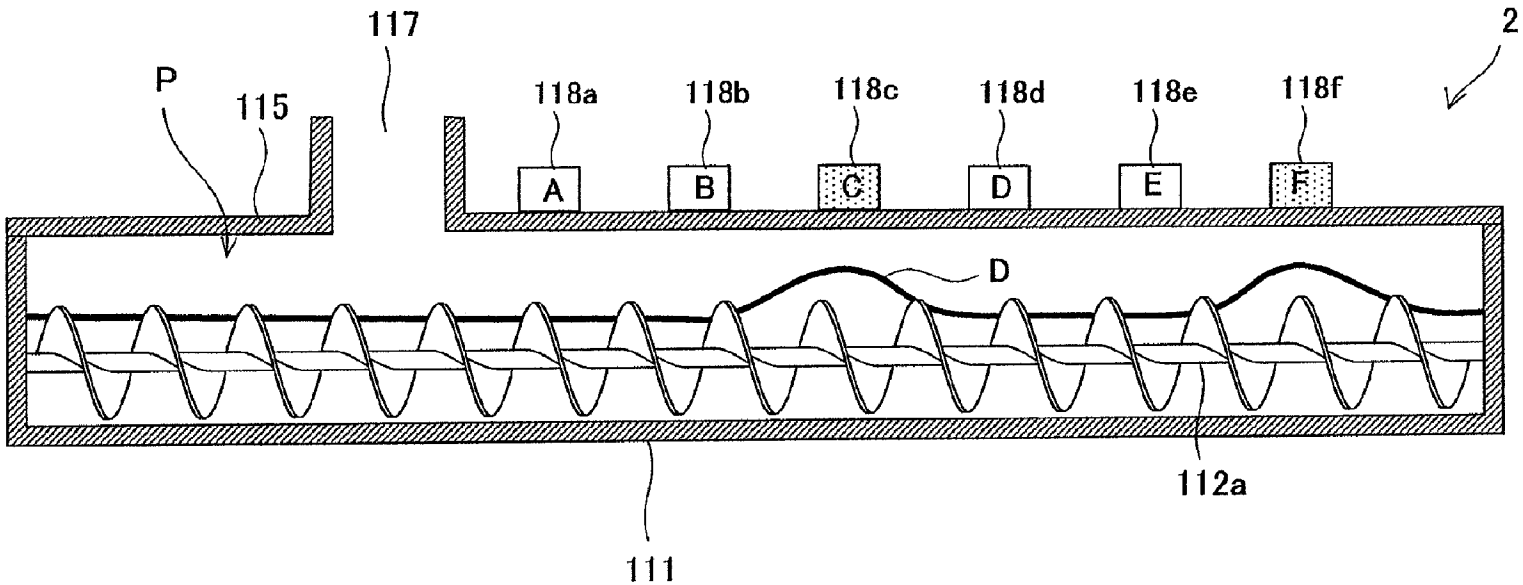
FIG. 10 is an illustrative view showing a state where the developer which was attracted to the electromagnets has dropped when the electromagnets in FIG. 9 are de-energized.

FIGS. 5 to 10 are schematic diagrams showing how the developer is conveyed as being moved up and down under the influence of the electromagnets arranged along the developer conveying passage in the developing device of the present embodiment. FIG. 5 is an illustrative view showing a state where the developer in the developer conveying passage has been attracted to particular two electromagnets of the electromagnets provided in the developing device when the electromagnets are energized. FIG. 6 is an illustrative view showing a state where the developer which was attracted to the electromagnets has dropped when the electromagnets in FIG. 5 are de-energized; FIG. 7 is an illustrative view showing a state where the developer in the developer conveying passage has been attracted to two electromagnets on the downstream side of the two electromagnets in FIG. 5, with respect to the direction of conveying the developer when the electromagnets are energized. FIG. 8 is an illustrative view showing a state where the developer which was attracted to the electromagnets has dropped when the electromagnets in FIG. 7 are de-energized. FIG. 9 is an illustrative view showing a state where the developer in the developer conveying passage has been attracted to two electromagnets on the downstream side of the two electromagnets in FIG. 7, with respect to the direction of conveying the developer when the electromagnets are energized. FIG. 10 is an illustrative view showing a state where the developer which was attracted to the electromagnets has dropped when the electromagnets in FIG. 9 are de-energized.

In image forming apparatus 100 of the present embodiment, when the developer in the first conveying passage P of developing device 2 is agitated and conveyed, the developer is agitated and conveyed as shown in FIG. 4 by rotating first conveying member 112*a* while flowing current through a pair of electromagnets, namely electromagnets A118*a* and D118*d*, electromagnets B118*b* and E118*e*, or electromagnets C118*c* and F118*f*, at the same time or while sequentially activating or deactivating the electromagnets, one to another in the downward direction with respect to the direction of conveying the developer.

The energization of current through electromagnets A118*a* to F118*f* is specifically performed such that electromagnets A118*a* and D118*d* are energized for 0.5 second, and de-energized for 0.5 second, as shown in FIGS. 5 and 6. Thereafter, as shown in FIGS. 7 and 8, electromagnets B118*b* and E118*e* are energized for 0.5 second, and de-energized for 0.5 second. Further, as shown in FIGS. 9 and 10, electromagnets C118*c* and F118*f* are energized for 0.5 second, and de-energized for 0.5 second. Then, electromagnets A118*a* and D118*d* are once again energized for 0.5 second. In this way, the energization of current through electromagnets A118*a* to F118*f* is performed repeatedly as described above.

First, when electromagnets A118*a* and D118*d* are energized, the developer D being conveyed by first conveying member 112*a* is attracted upward to electromagnets A118*a* and D118*d* by the magnetic fields generated by electromagnets A118*a* and D118*d*, as shown in FIG. 5.

When electromagnets A118*a* and D118*d* are de-energized, the magnetic fields generated by electromagnets A118*a* and D118*d* vanish so that the developer D attracted to electromagnets A118*a* and D118*d* is released and drops as shown in FIG. 6.

Next, when electromagnets B118*b* and E118*e*, which are located downstream of electromagnets A118*a* and D118*d*, respectively with respect to the direction of conveying the developer, are energized, the developer D being conveyed by first conveying member 112*a* is attracted upward to electromagnets B118*b* and E118*e* by the magnetic fields generated by electromagnets B118*b* and E118*e*, as shown in FIG. 7.

When electromagnets B118*b* and E118*e* are de-energized, the magnetic fields generated by electromagnets B118*b* and E118*e* vanish so that the developer D attracted to electromagnets B118*b* and E118*e* is released and drops as shown in FIG. 8.

Next, when electromagnets C118*c* and F118*f*, which are located downstream of electromagnets B118*b* and E118*e*, respectively with respect to the direction of conveying the developer, are energized, the developer D being conveyed by first conveying member 112*a* is attracted upward to electromagnets C118*c* and F118*f* by the magnetic fields generated by electromagnets C118*c* and F118*f*, as shown in FIG. 9.

When electromagnets C118*c* and F118*f* are de-energized, the magnetic fields generated by electromagnets C118*c* and F118*f* vanish so that the developer D having attracted to electromagnets C118*c* and F118*f* is released and drops as shown in FIG. 10.

In the above way, a plurality of electromagnets A118*a* to F118*f* are energized in sequential order by shifting the energization timing of one electromagnet to the next, toward the downstream side of the direction of conveying the developer to generate a varying magnetic field, whereby the developer D is once raised by the magnetic fields generated by one of the electromagnets, then is attracted to the neighboring electromagnet on the downstream side in the direction of conveying the developer. As a result it is possible to efficiently convey developer D.

Further, when a varying magnetic field is generated by shifting the energization timing of electromagnets A118*a* to F118*f*, a period of time during which any of neighboring two electromagnets do not produce magnetic fields at the same time or during which two electromagnets on both sides of one electromagnet that produces a magnetic field do not produce any magnetic field, is provided. As a result, the developer D once attracted by the magnetic field of one electromagnet is dropped and then is attracted by another electromagnet located on the downstream side in the direction of conveyance, so that it is possible to improve conveying performance while increasing the up-and-down movement of the developer.

When a varying magnetic field is generated by shifting the energization timing of electromagnets A118*a* to F118*f*, sinusoidal currents are made to flow through electromagnets A118*a* to F118*f* so as to generate sinusoidally varying magnetic fields. In this way, changing the currents through the electromagnets slowly so that the magnetic flux density varies sinusoidally along the time axis, makes it possible to alleviate impact when the developer is attracted to the electromagnet and/or when the developer falls, whereby it is possible to reduce stress on the developer.

Further, when sinusoidal currents are made to flow through electromagnets A118*a* to F118*f*, the sinusoidal currents are delayed in phase within the range of 90° to 120° as it goes downstream with respect to the developer's direction of conveyance, so that the magnetic flux density of the magnetic field varies slowly, whereby it is possible to suppress stagnation of the developer and reduce stress on the developer.

According to the present embodiment configured as above, a plurality of electromagnets A118*a* to F118*f* are arranged along the direction of conveying the developer, in the upper part of the first conveying passage P in developing vessel 111 of developing device 2, and on the downstream side of toner supply port 117 with respect to the direction of conveying the developer, and the energization timing of electromagnets A118*a* to F118*f* is delayed from one to the next toward the downstream of the direction of conveying the developer, so that developer D is conveyed moving up and down as developer D is being attracted to the electromagnets, one to the next as the developer advances downstream in the direction of conveying the developer. Accordingly, it is possible to improve agitation performance and conveying performance of developer D. As a result, it is possible to suppress the occurrence of the defective agitation, or Debemoko phenomenon, thereby alleviating the problems of insufficient image density and toner scattering and image fogging due to toner with insufficient static electricity.

Though the above embodiment was described taking the example in which the developing device 2 of the present invention is applied to image forming apparatus 100 shown in FIG. 1, as long as it is an image forming apparatus in which toner is supplied to developing device 2 using toner hopper 101, the invention can be developed to any other image forming apparatus and the like, not limited to the image forming apparatus and copier described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A developer conveying method for conveying a developer including a toner and a magnetic carrier in a developer conveying passage, in a predetermined direction whilst agitating the developer and the supplied toner by a developer conveying member, comprising the steps of:

generating intermittent magnetic fields at plural areas in an upper part of the developer conveying passage along a direction of conveying the developer; and, conveying the developer whilst alternating attraction and release of the developer by the magnetic fields that are intermittently generated in the developer conveying passage, wherein when the generation timing of the magnetic fields intermittently generated at plural areas in the upper part of the developer conveying passage is delayed as the area goes toward the downstream side of the direction of conveying the developer, the magnetic field is not simultaneously generated by the two electromagnetics adjacent to each other.

2. The developer conveying method according to claim 1, wherein the magnetic fields intermittently generated at plural areas in the upper part of the developer conveying passage are a sinusoidal magnetic field generated by flowing a sinusoidal current through electromagnets.

3. The developer conveying method according to claim 2, wherein the generation timing of the magnetic fields intermittently generated at plural areas in the upper part of the developer conveying passage is delayed in phase of the sinusoidal current by the range of 90° to 120° as the area goes downstream with respect to the direction of conveying the developer.

* * * * *